US009620135B2

(12) United States Patent
Kishi et al.

(10) Patent No.: US 9,620,135 B2
(45) Date of Patent: Apr. 11, 2017

(54) AUDIO ENCODING DEVICE AND AUDIO ENCODING METHOD

(71) Applicant: FUJITSU LIMITED, Kawasaki-shi, Kanagawa (JP)

(72) Inventors: Yohei Kishi, Kawasaki (JP); Akira Kamano, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/836,355

(22) Filed: Aug. 26, 2015

(65) Prior Publication Data

US 2016/0118051 A1 Apr. 28, 2016

(30) Foreign Application Priority Data

Oct. 24, 2014 (JP) ..... 2014-217669

(51) Int. Cl.
*G10L 19/00* (2013.01)
*G10L 19/032* (2013.01)

(52) U.S. Cl.
CPC ..... *G10L 19/032* (2013.01)

(58) Field of Classification Search
CPC ..... G10L 19/032; G10L 19/0204
USPC ..... 704/500; 382/199, 298, 299, 300
See application file for complete search history.

(56) References Cited

U.S. PATENT DOCUMENTS 7,876,979 B2 * 1/2011 Lee ..... G06T 3/403 382/199
2007/0168186 A1 7/2007 Ide

FOREIGN PATENT DOCUMENTS

| | | |
|---|---|---|
| EP | 0 709 006 | 3/1997 |
| JP | 9-500502 | 1/1997 |
| JP | 2007-193043 | 8/2007 |

OTHER PUBLICATIONS

"Text of ISO/IEC13818-7:2005 (MPEG-2 AAC 4th edition)", ISO/IEC JTC1/SC29/WG11, N7126, pp. i-181, Apr. 2006, Busan KR.
"3GPP TS 26.403 V11.0.0, General audio codec audio processing functions; Enhanced aacPlus general audio codec: Encoder specification; Advanced Audio Coding (AAC) part; (Release 11)", Relation between bit demand and perceptual entropy, Sep. 2012.

* cited by examiner

*Primary Examiner* — Charlotte M Baker
(74) *Attorney, Agent, or Firm* — Staas & Halsey LLP

(57) ABSTRACT

An audio encoding device includes a processor; and a memory which stores a plurality of instructions, which when executed by the processor, cause the processor to execute: detecting a plurality of lobes based on a frequency signal constituting an audio signal; calculating a masking threshold value of the frequency signal; allocating an amount of bits per unit frequency region to be allocated for encoding of the frequency signal on a basis of the masking threshold value; selecting a main lobe on a basis of bandwidth and power of the lobes; and controlling the encoding by reducing the amount of bits in a first region including a maximum value of the power in the main lobe.

20 Claims, 14 Drawing Sheets

FIG. 12

| | OBJECTIVE SOUND QUALITY EVALUATION VALUE |
|---|---|
| COMPARATIVE EXAMPLE | −1.75 |
| FIRST EXAMPLE | −1.50 |

AUDIO ENCODING DEVICE AND AUDIO ENCODING METHOD

CROSS-REFERENCE TO RELATED APPLICATION

This application is based upon and claims the benefit of priority of the prior Japanese Patent Application No. 2014-217669, filed on Oct. 24, 2014, the entire contents of which are incorporated herein by reference.

FIELD

The embodiment disclosed herein is related to an audio encoding device, an audio encoding method, and an audio encoding program, for example.

BACKGROUND

In related art, audio encoding technologies that compress audio signals (sound sources of voice, music, and the like) have been developed. For example, as the audio encoding technologies, there are an advanced audio coding (MC) system, a high efficiency-advanced audio coding (HE-AAC) system, and the like. The MC system and the HE-AAC system are each one of moving picture experts group (MPEG)-2/4 audio standards of International Organization for Standardization/International Electrotechnical Commission (ISO/IEC), and are widely used for purposes of broadcasting such for example as digital broadcasting or the like.

In broadcasting applications, audio signals may need to be transmitted under the constraint of a limited transmission bandwidth. Therefore, when audio signals are to be encoded at a low bit rate, it is not possible to encode audio signals in all of frequency bands, and thus bands in which to perform encoding may need to be selected. Incidentally, in general, in the MC system, about 64 kbps or less may be regarded as a low bit rate, and about 128 kbps or more may be regarded as a high bit rate. Japanese Laid-open Patent Publication No. 2007-193043, for example, discloses a technology that performs encoding while omitting audio signals having less than a given power so that a given bit rate is not exceeded.

SUMMARY

In accordance with an aspect of the embodiments, an audio encoding device includes a processor; and a memory which stores a plurality of instructions, which when executed by the processor, cause the processor to execute: detecting a plurality of lobes based on a frequency signal constituting an audio signal; calculating a masking threshold value of the frequency signal; allocating an amount of bits per unit frequency region to be allocated for encoding of the frequency signal on a basis of the masking threshold value; selecting a main lobe on a basis of bandwidth and power of the lobes; and controlling the encoding by reducing the amount of bits in a first region including a maximum value of the power in the main lobe.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 12 illustrates objective evaluation values of a first example and a comparative example;

DESCRIPTION OF EMBODIMENTS

An example of an audio encoding device, an audio encoding method, an audio encoding computer program, and an audio encoding and decoding device according to one embodiment will hereinafter be described in detail with reference to the drawings. It is to be noted that the present example does not limit the disclosed technology.

First Example

Figure 1:
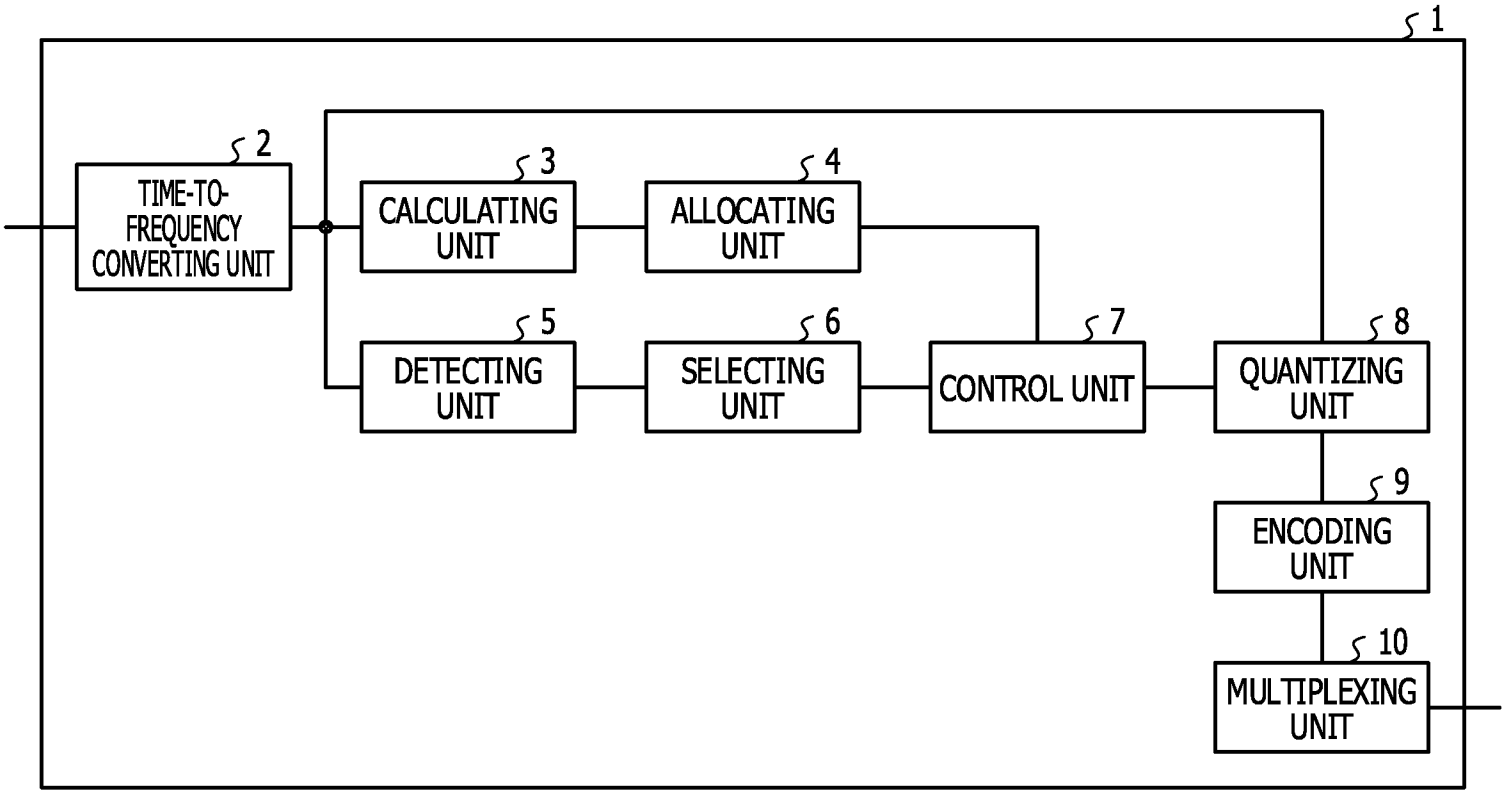
FIG. 1 is a functional block diagram of an audio encoding device according to one embodiment.
Figure 2:
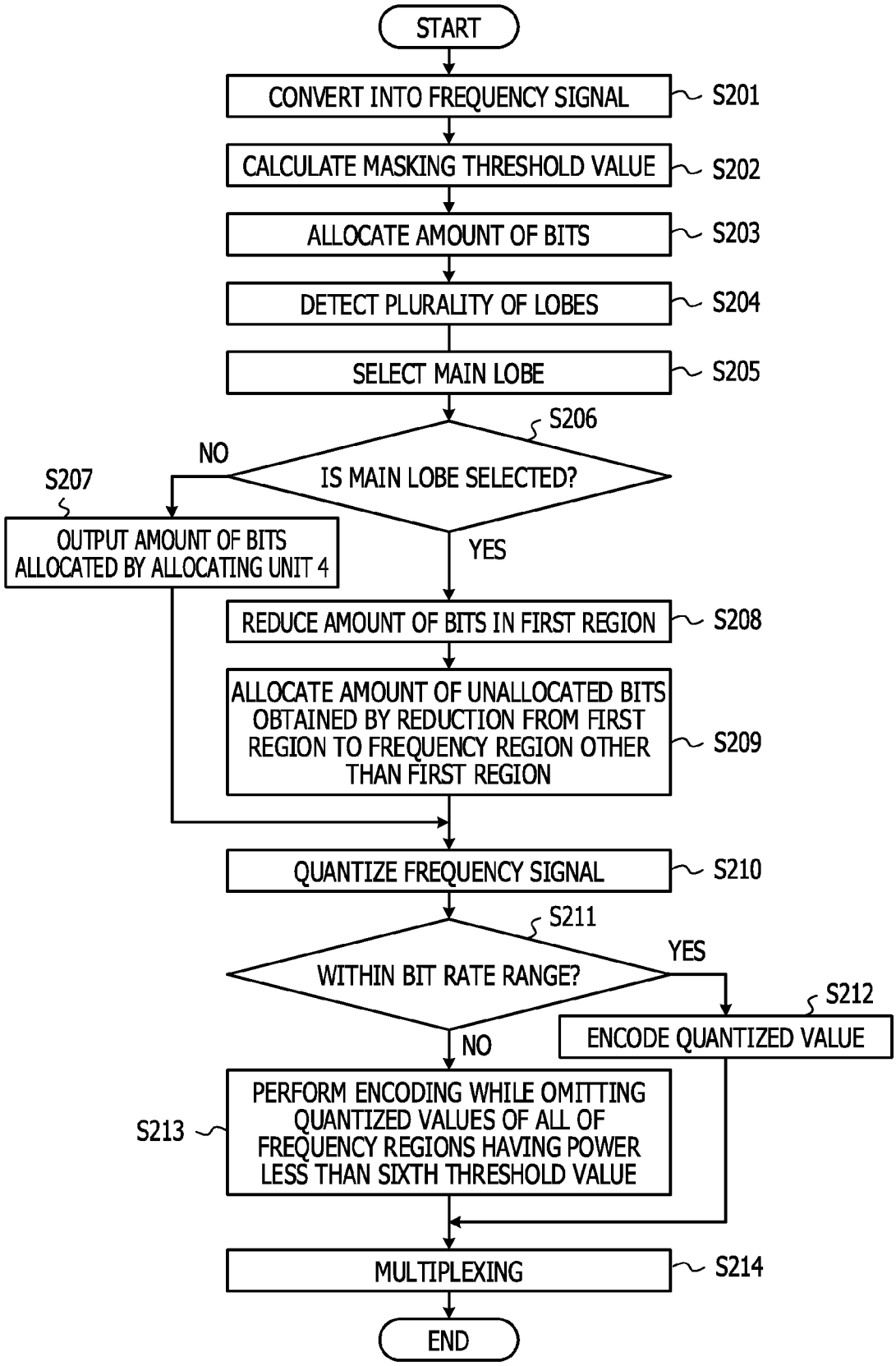
FIG. 2 is a flowchart of encoding processing of an audio encoding device.

FIG. 1 is a functional block diagram of an audio encoding device according to one embodiment. FIG. 2 is a flowchart of encoding processing of the audio encoding device. In the first example, a flow of the encoding processing by the audio encoding device illustrated in FIG. 2 will be described in such a manner as to be associated with the description of each function in the functional block diagram of the audio encoding device illustrated in FIG. 1. As illustrated in FIG. 1, an audio encoding device 1 includes a time-to-frequency converting unit 2, a calculating unit 3, an allocating unit 4, a detecting unit 5, a selecting unit 6, a control unit 7, a quantizing unit 8, an encoding unit 9, and a multiplexing unit 10.

The above-described units possessed by the audio encoding device 1 are each formed as a separate hardware circuit based on wired logic, for example. Alternatively, the above-described units possessed by the audio encoding device 1 may be implemented in the audio encoding device 1 as one integrated circuit in which circuits corresponding to the respective units are integrated. Incidentally, it suffices for the integrated circuit to be an integrated circuit such for example as an application specific integrated circuit (ASIC), a field programmable gate array (FPGA), or the like. Further, the above-described units possessed by the audio encoding device 1 may be a function module implemented by a computer program executed on a computer processor possessed by the audio encoding device 1.

The time-to-frequency converting unit 2 is for example a hardware circuit based on wired logic. In addition, the time-to-frequency converting unit 2 may be a function module implemented by a computer program executed by the audio encoding device 1. The time-to-frequency converting unit 2 converts a signal of each channel in a time domain of an audio signal input to the audio encoding device 1 (which audio signal is for example an Nch (N=2, 3, 3.1, 5.1, or 7.1) multichannel audio signal) into a frequency signal of each channel by subjecting the signal of each channel in the time domain to time-to-frequency conversion in frame units. Incidentally, such processing corresponds to step S201 in the flowchart illustrated in FIG. 2. In the first example, the time-to-frequency converting unit 2 converts the signal of each channel into a frequency signal by using a fast Fourier transform, for example. In this case, a conversion equation for converting a signal Xch(t) in the time domain of a channel ch in a frame t into a frequency signal is expressed as in the following equation, for example.

$$spec_{ch}(t)_i = \sum_{k=0}^{S-1} X_{ch}(t)\exp\left(-j\frac{2\pi \cdot i \cdot k}{S}\right), \quad i = 0, \ldots, S-1 \qquad \text{(Equation 1)}$$

In the above (Equation 1), k is a variable representing time, and represents a kth time when an audio signal of one frame is divided into S equal parts in a time direction. Incidentally, a frame length may be defined as any length in a range of 10 msec to 80 msec, for example. i is a variable representing frequency, and represents an ith frequency when an entire frequency band is divided into S equal parts. Incidentally, S is set to be 1024, for example. $spec_{ch}(t)_i$ represents an ith frequency signal of the channel ch in the frame t. Incidentally, the time-to-frequency converting unit 2 may convert the signal in the time domain of each channel into a frequency signal by using other arbitrary time-to-frequency conversion processing such as a discrete cosine transform (DCT transform), a modified discrete cosine transform (MDCT transform), a quadrature mirror filter (QMF) filter bank, or the like. Each time the time-to-frequency converting unit 2 calculates a frequency signal of each channel in frame units, the time-to-frequency converting unit 2 outputs the frequency signal of each channel to the calculating unit 3, the detecting unit 5, and the quantizing unit 8.

The calculating unit 3 is for example a hardware circuit based on wired logic. In addition, the calculating unit 3 may be a function module implemented by a computer program executed by the audio encoding device 1. The calculating unit 3 divides the frequency signal of each channel in each frame into a plurality of bands each having a given bandwidth, and calculates a spectral power and a masking threshold value in each of the bands. Incidentally, such processing corresponds to step S202 in the flowchart illustrated in FIG. 2. The calculating unit 3 may calculate the spectral power and the masking threshold value by using a method described in C.1 Psychoacoustic Model of Annex C of ISO/IEC 13818-7, for example. Incidentally, ISO/IEC 13818-7 is one of international standards jointly established by the International Organization for Standardization (ISO) and the International Electrotechnical Commission (IEC).

The calculating unit 3 calculates the spectral power of each band according to the following equation, for example.

$$specPow_{ch}[b](t) = \sum_{i}^{bw[b]} spec_{ch}(t)_i^2 \qquad \text{(Equation 2)}$$

Incidentally, in the above (Equation 2), $specPow_{ch}[b](t)$ is power representing the spectral power of a frequency band b of the channel ch in the frame t, and bw[b] denotes the bandwidth of the frequency band b.

The calculating unit 3 calculates, for each frequency band, a masking threshold value that represents a power as a lower limit of the frequency signal of a sound that may be perceived by a listener (who may be referred to as a user). In addition, the calculating unit 3 may for example output a value preset for each frequency band as the masking threshold value. Alternatively, the calculating unit 3 may calculate the masking threshold value according to the auditory characteristics of the listener. In this case, the masking threshold value for a frequency band of interest in the frame to be encoded is increased with increases in the power of the spectral power of the same frequency band in a frame preceding the frame to be encoded and the power of the spectral power of adjacent frequency bands in the frame to be encoded. The calculating unit 3 may for example calculate the masking threshold value according to processing of calculating a threshold value (corresponding to the masking threshold value) which processing is described in the item of C.1.4 Steps in Threshold Calculation in C.1 Psychoacoustic Model in Annex C of ISO/IEC 13818-7. In this case, the calculating unit 3 calculates the masking threshold value using frequency signals in a first previous frame and a second previous frame that precede the frame to be encoded. The calculating unit 3 may therefore include a memory or a cache not illustrated in the figures to store the frequency signals in the first previous frame and the second previous frame that precede the frame to be encoded. The calculating unit 3 outputs the masking threshold value of each channel to the allocating unit 4. In addition, the calculating unit 3 outputs the frequency signal of each channel which frequency signal is received from the time-to-frequency converting unit 2 to the allocating unit 4.

The allocating unit 4 is for example a hardware circuit based on wired logic. In addition, the allocating unit 4 may be a function module implemented by a computer program executed by the audio encoding device 1. The allocating unit 4 receives the masking threshold value and the frequency signal of each channel from the calculating unit 3. The allocating unit 4 allocates an amount of bits per unit frequency region to be allocated for the encoding of the frequency signal on the basis of a ratio between the power of the frequency signal and the masking threshold value of each channel (hereinafter referred to as a signal to masking threshold ratio (SMR)), for example. Incidentally, such processing corresponds to step S203 in the flowchart illustrated in FIG. 2. The allocating unit 4 outputs the amount of allocated bits to the control unit 7.

The allocating unit 4 may allocate the amount of bits using a method described in "TS 26.403 V11.0.0 General audio codec audio processing functions; Enhanced aacPlus general audio codec; Encoder specification; Advanced Audio Coding (MC) part; Relation between bit demand and perceptual entropy," for example. For example, the allocating unit 4 may define the amount of allocated bits per unit frequency region on the basis of a bit estimated value referred to as a pe value (Perceptual Entropy). Incidentally, the pe value may be calculated on the basis of the following equation, for example.

$$pe = peOffset + \sum_{n} sfbPe(n) \quad \text{(Equation 3)}$$

$$sfbPe = nl \cdot \begin{cases} \log_2\left(\frac{en}{thr}\right) & \text{for } \log_2\left(\frac{en}{thr}\right) \geq cl \\ \left(c2 + c3 \cdot \log_2\left(\frac{en}{thr}\right)\right) & \text{for } \log_2\left(\frac{en}{thr}\right) < cl \end{cases}$$

In addition, the allocating unit 4 may convert the pe value calculated in the above (Equation 3) into an amount of allocated bits (bits) on the basis of the following equation, for example.

$$\text{bits}=pe/1.18 \quad \text{(Equation 4)}$$

As may be understood from the above (Equation 3) and (Equation 4), the higher the SMR, the larger the amount of allocated bits. Therefore, the amount of allocated bits for a frequency region having a high SMR is increased, whereas the amount of allocated bits for a frequency region having a low SMR is decreased. In the case of a small amount of allocated bits, sound quality may be degraded due to a shortage of the amount of bits that may be necessary for encoding. According to one viewpoint of the first example, encoding may be performed with high sound quality even under low-bit-rate encoding conditions by suppressing the shortage of the amount of bits that may be necessary for encoding.

The detecting unit 5 is for example a hardware circuit based on wired logic. In addition, the detecting unit 5 may be a function module implemented by a computer program executed by the audio encoding device 1. The detecting unit 5 receives the frequency signal of each channel from the time-to-frequency converting unit 2. The detecting unit 5 detects a plurality of lobes formed by the frequency signal of each channel constituting the audio signal. Incidentally, such processing corresponds to step S204 in the flowchart illustrated in FIG. 2. For example, the detecting unit 5 may calculate a plurality of points of inflection of the power of the frequency signal (which plurality of points of inflection may be referred to as a group of points of inflection) by an arbitrary method (for example, second order differential), and detect, as one lobe, an interval from a point of downward convex inflection A to a point of downward convex inflection B adjacent to the point of inflection A. (In addition, the length of the interval may be referred to as the width of the lobe. Further, the width may be referred to as a bandwidth or a frequency bandwidth.) Incidentally, a half width at a half maximum of the lobe may be used as the width of the lobe.

Figure 3:
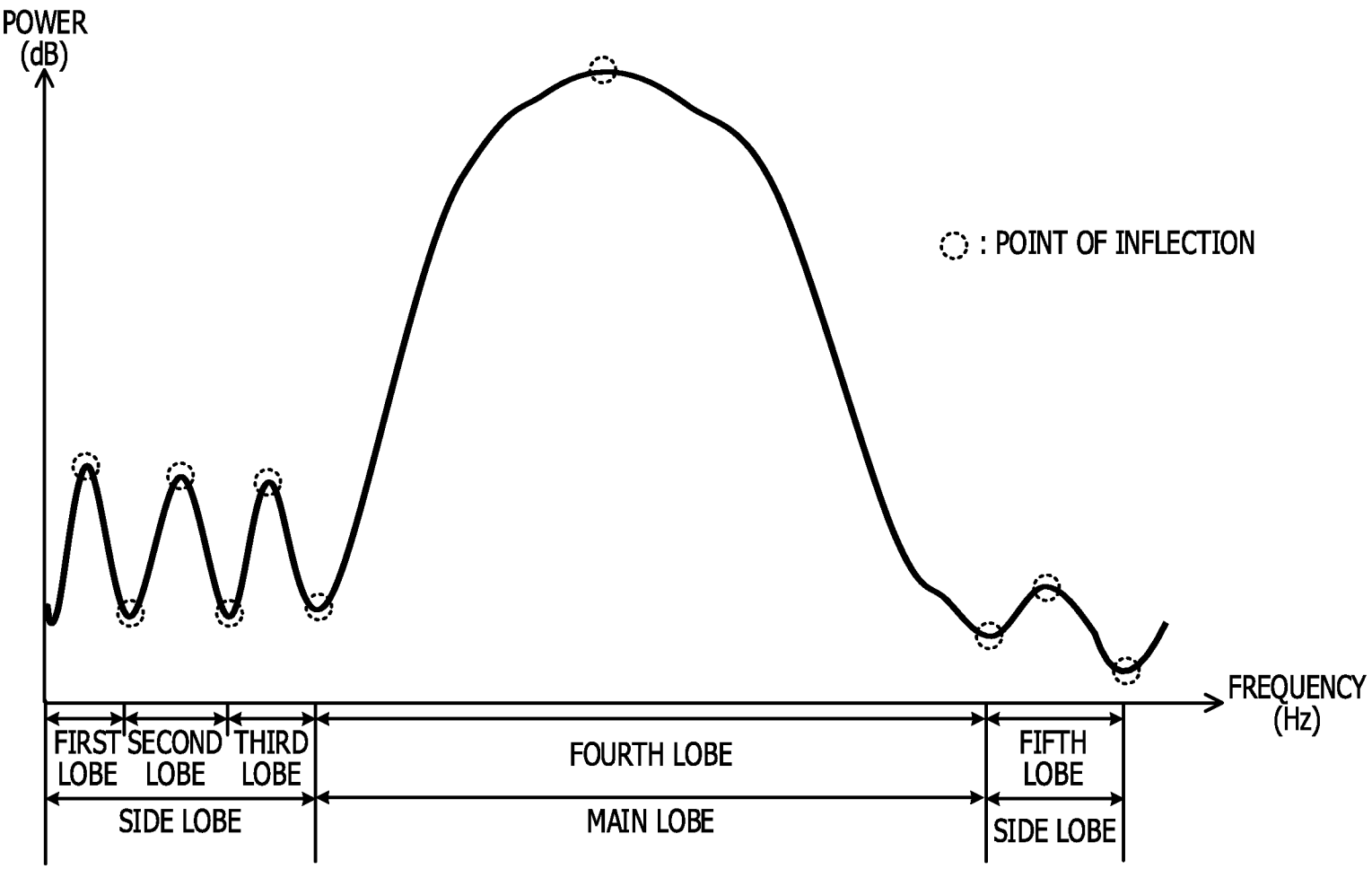
FIG. 3 is a spectrum diagram of a fricative consonant.
Figure 4:
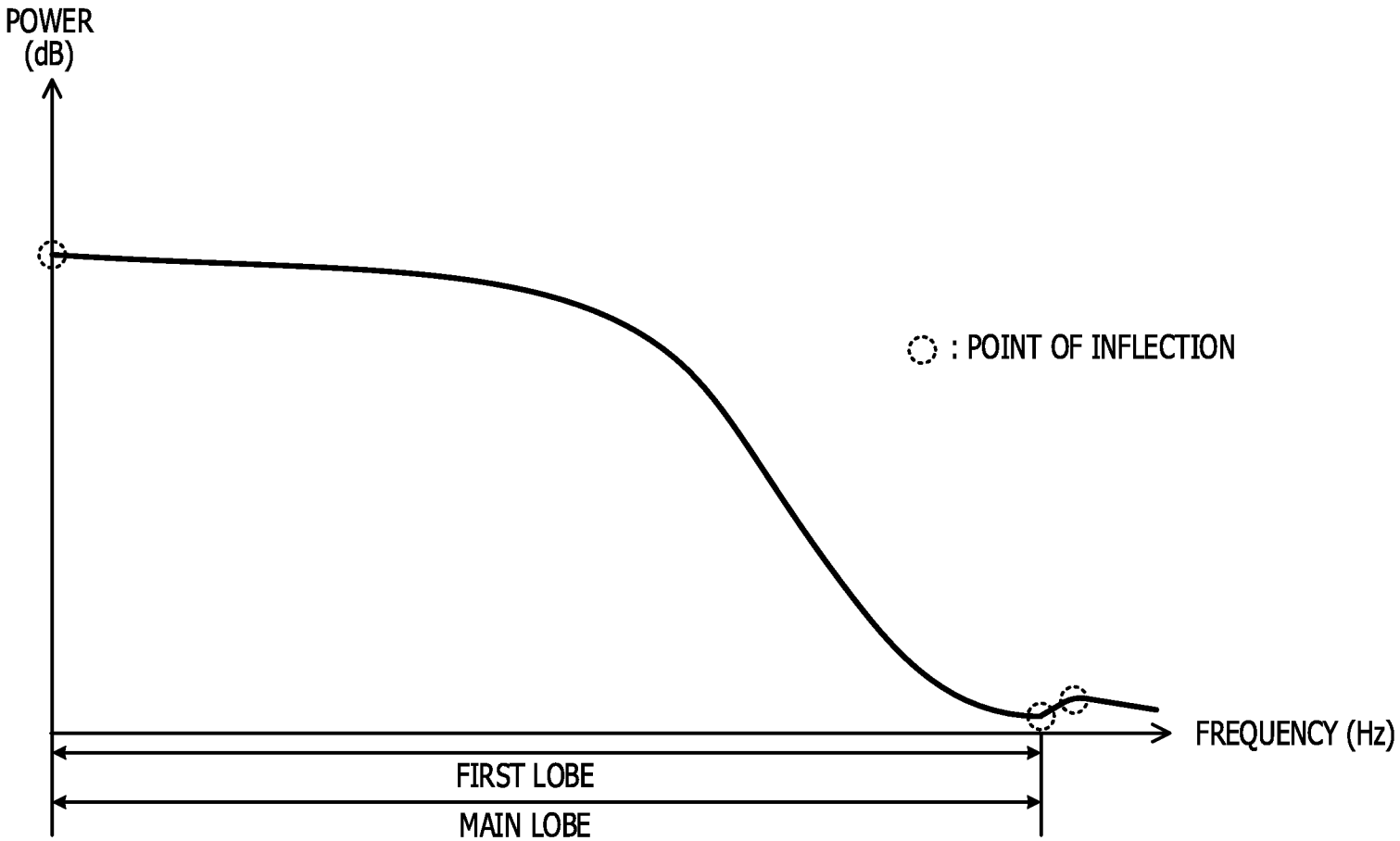
FIG. 4 is a spectrum diagram of a consonant other than fricatives.
Figure 5:
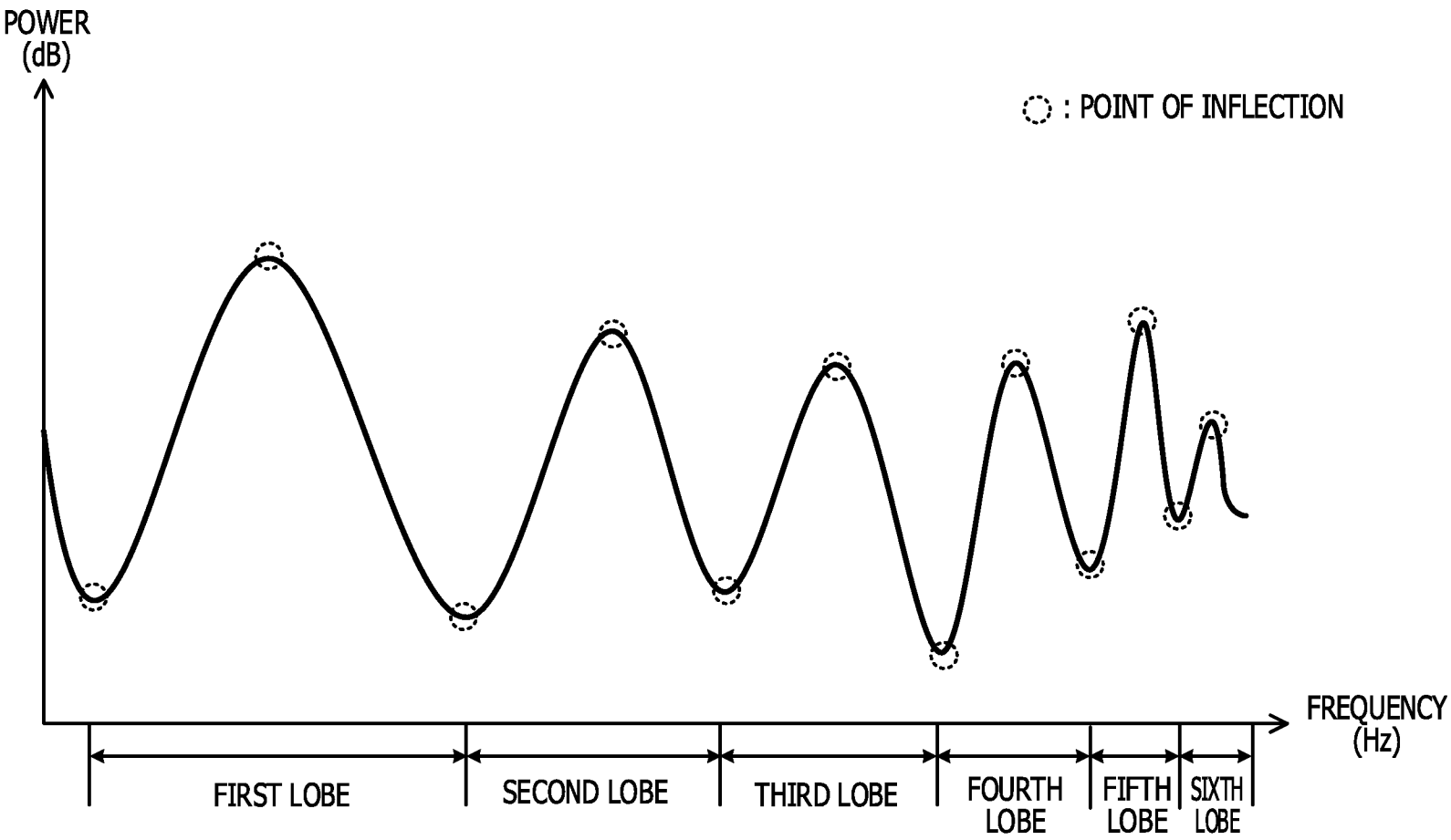
FIG. 5 is a spectrum diagram of a vowel.

FIG. 3 is a spectrum diagram of a fricative consonant. FIG. 4 is a spectrum diagram of a consonant other than fricatives. FIG. 5 is a spectrum diagram of a vowel. As illustrated in FIG. 3 and FIG. 5, the detecting unit 5 detects a plurality of points of inflection (that may be referred to as a group of points of inflection), and detects, as a lobe, an interval between points of downward convex inflection which points are adjacent to each other. Incidentally, in the spectrum of the consonant other than fricatives in FIG. 4, at least one lobe may be detected by defining a value at which the power is at a maximum in a low frequency region as a point of downward convex inflection in a pseudo manner. For example, the detecting unit 5 may detect, as one lobe, an interval from the point of inflection C in the low frequency region which point is defined in a pseudo manner and at which point the power is at the maximum to the point of downward convex inflection D adjacent to the point of inflection C. (In addition, the length of the interval may be referred to as the width of the lobe. Further, the width may be referred to as a bandwidth or a frequency bandwidth.) The detecting unit 5 outputs the detected plurality of lobes of each channel to the selecting unit 6.

The selecting unit 6 in FIG. 1 is for example a hardware circuit based on wired logic. In addition, the selecting unit 6 may be a function module implemented by a computer program executed by the audio encoding device 1. The selecting unit 6 receives the plurality of lobes in each channel from the detecting unit 5. The selecting unit 6 selects a main lobe on the basis of the width of the plurality of lobes and the power of the lobes. Incidentally, such processing corresponds to step S205 in the flowchart illustrated in FIG. 2. For example, the selecting unit 6 selects a lobe having a largest width among the plurality of lobes as a main lobe candidate, and selects the main lobe candidate as a main lobe when the width (frequency bandwidth) of the main lobe candidate is equal to or more than a given first threshold value (Th1) (for example, first threshold value=10 kHz) and the power of the main lobe candidate is equal to or more than a given second threshold value (Th2) (for example, second threshold value=20 dB). Incidentally, the selecting unit 6 may use, as the power, an absolute value of a difference between a maximum value and a minimum value of each lobe, for example. In addition, the selecting unit 6 may use, as the power, a ratio between the maximum value and the minimum value of the lobe. Incidentally, the main lobe may be referred to as a first lobe.

For example, in the spectrum of the fricative consonant illustrated in FIG. 3, a fourth lobe has a largest width. The selecting unit 6 therefore selects the fourth lobe as a main lobe candidate. The selecting unit 6 determines whether or not the width of the fourth lobe that is the main lobe candidate is equal to or more than the first threshold value. Incidentally, for the convenience of description, in the first example, suppose that the width of the fourth lobe that is the main lobe candidate is equal to or more than the first threshold value. When the width of the fourth lobe that is the main lobe candidate satisfies the condition that the width of the fourth lobe that is the main lobe candidate be equal to or more than the first threshold value, the selecting unit 6 next determines whether or not the power of the fourth lobe that is the main lobe candidate is equal to or more than the second threshold value. Incidentally, for the convenience of description, in the first example, suppose that the power of the fourth lobe that is the main lobe candidate is equal to or more than the second threshold value. The selecting unit 6 may thus select the fourth lobe that is the main lobe candidate as the main lobe. In other words, the main lobe is a lobe that has a largest width among the plurality of lobes detected by the detecting unit 5 and satisfies the condition that the width of the lobe be equal to or more than the first threshold value and which lobe has a power equal to or more than the second threshold value. Incidentally, lobes other than the main lobe (a first to a third lobe and a fifth lobe) may be referred to as a side lobe. In addition, the side lobe may be referred to as a second lobe.

In addition, in the spectrum of the consonant other than fricatives which spectrum is illustrated in FIG. 4, at least one lobe may be detected by defining the value of a frequency at which the power is at a maximum in the low frequency region as a point of inflection in a pseudo manner. When only one lobe, that is, the first lobe is detected, the selecting unit 6 selects the detected first lobe as a main lobe candidate. The selecting unit 6 may select the first lobe that is the main lobe candidate as the main lobe when the width (frequency bandwidth) of the main lobe candidate is equal to or more than the given first threshold value (Th1) (for example, first threshold value=10 kHz) and the power of the main lobe candidate is equal to or more than the given second threshold value (Th2) (for example, second threshold value=20 dB). Incidentally, for the convenience of description, in the first example, suppose that the width of the first lobe that is the main lobe candidate is equal to or more than the first threshold value and that the power of the first lobe that is the main lobe candidate is equal to or more than the second threshold value. In addition, even when the detecting unit 5 detects a plurality of lobes, the selecting unit 6 may for example select a lobe having a largest width among the plurality of lobes as a main lobe candidate, and select the main lobe candidate as the main lobe when the width (frequency bandwidth) of the main lobe candidate is equal to or more than the first threshold value (Th1) and the power of the main lobe candidate is equal to or more than the given second threshold value (Th2).

Further, in the spectrum of the vowel which spectrum is illustrated in FIG. 5, a first lobe is a widest lobe. The first lobe is therefore selected as a main lobe candidate. The selecting unit 6 determines whether or not the width of the first lobe that is the main lobe candidate is equal to or more than the first threshold value. Incidentally, for the convenience of description, in the first example, suppose that the width of the first lobe that is the main lobe candidate is less than the first threshold value. Because the width of the first lobe that is the main lobe candidate is less than the first threshold value, the first lobe that is the main lobe candidate is not selected as the main lobe. Incidentally, in other words, it suffices to empirically define, as the first threshold value and the second threshold value, threshold values satisfying conditions that may select only the main lobes of the fricative consonant and the consonant other than fricatives which main lobes are respectively illustrated in FIG. 3 and FIG. 4. The selecting unit 6 outputs the main lobe selected for each channel to the control unit 7. Incidentally, when the selecting unit 6 does not select a main lobe, the selecting unit 6 may perform selection processing for a next frame or another channel.

Figure 6:
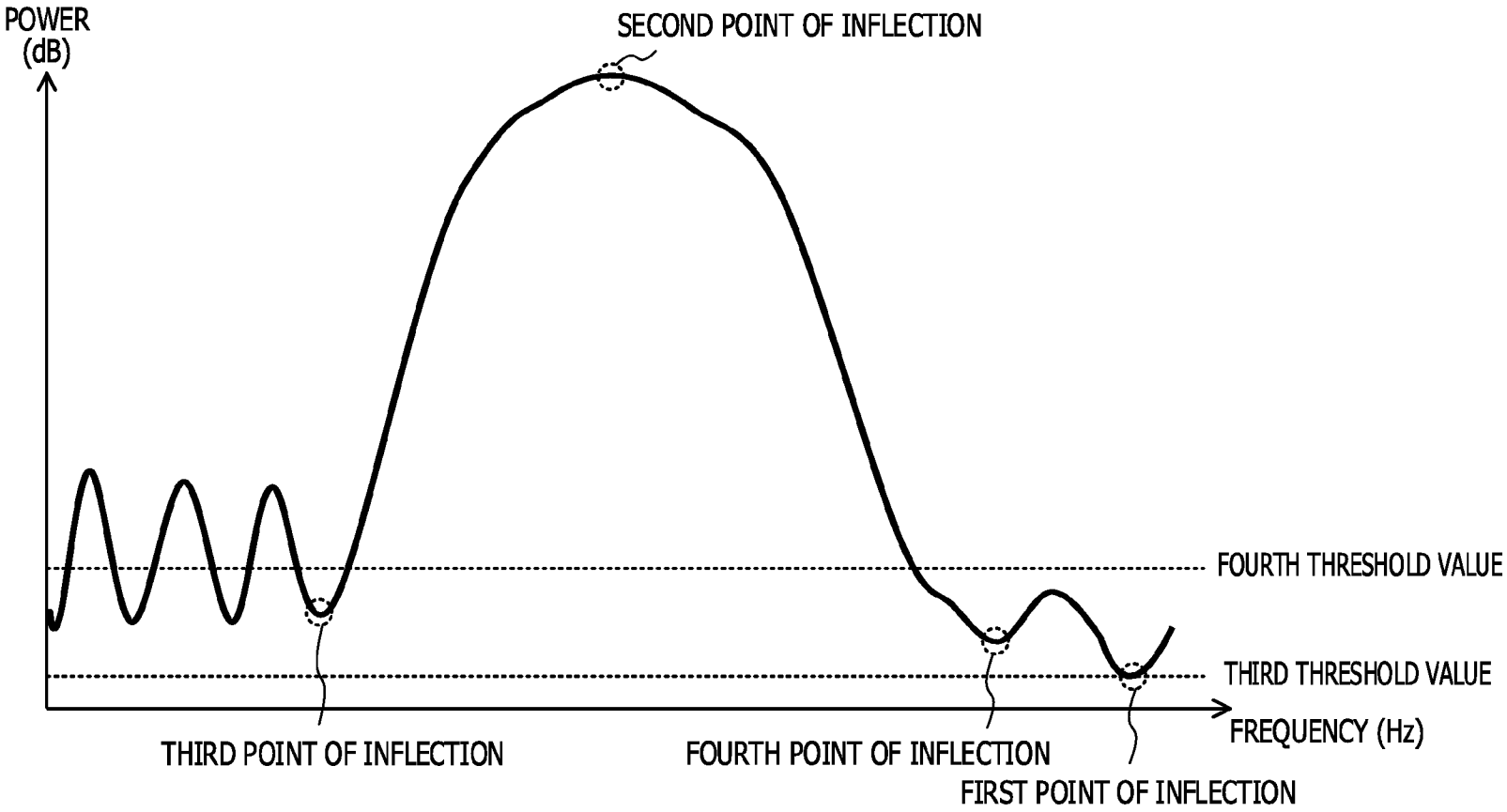
FIG. 6 is a first conceptual diagram of selection of a band of a main lobe.

Incidentally, the selecting unit 6 may define the value of a first point of inflection at which the power of a lobe is at a minimum in a group of points of inflection as a third threshold value (Th3), and define a value increased from the third threshold value by a given power (for example, 3 dB) as a fourth threshold value (Th4). Further, the selecting unit 6 may select, as a starting point and an end point of a main lobe, a third point of inflection and a fourth point of inflection that are adjacent, on a low frequency side and a high frequency side, respectively, to a second point of inflection at which the power of the main lobe is at a maximum in the group of the points of inflection, and are equal to or more than the third threshold value and less than the fourth threshold value. FIG. 6 is a first conceptual diagram of selection of a band of the main lobe. Incidentally, as with FIG. 3, FIG. 6 illustrates the spectrum of the fricative consonant. As illustrated in FIG. 6, the third threshold value and the fourth threshold value as well as the first to fourth points of inflection are defined, and the starting point and the end point of the main lobe are defined. Incidentally, an interval from the starting point to the end point may be treated as the band (width) of the lobe. By using the method disclosed in FIG. 6, even when a spike-like noise or frequency signal is superimposed on the main lobe, the selecting unit 6 may select the main lobe while excluding effects of the spike-like noise or frequency signal.

Figure 7:
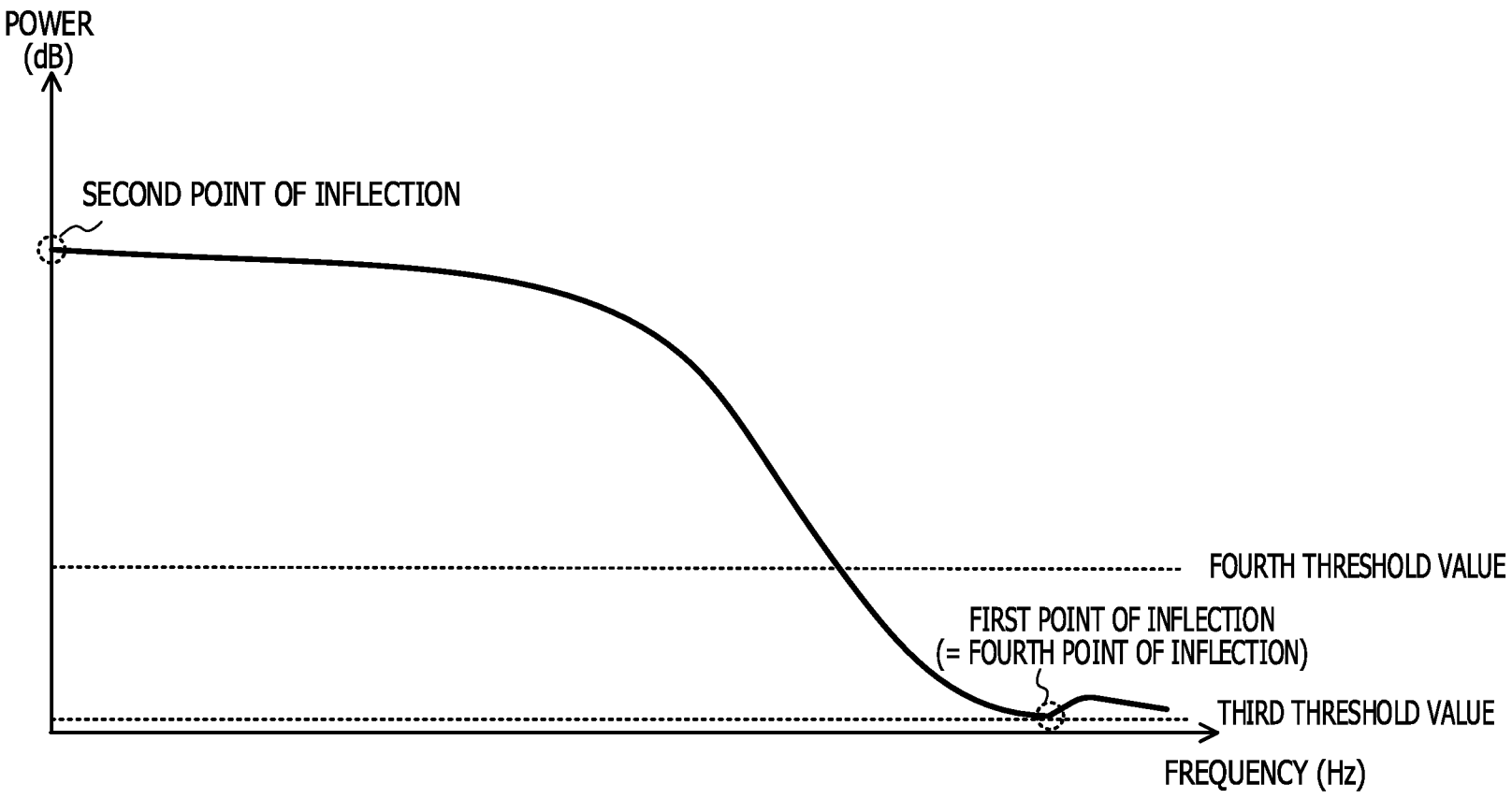
FIG. 7 is a second conceptual diagram of selection of a band of a main lobe.

Further, when there is no third point of inflection adjacent on the low frequency side to the second point of inflection at which the power of the main lobe is at a maximum in FIG. 6, so that the selecting unit 6 does not select the third point of inflection, the selecting unit 6 may be selecting the main lobe from the spectrum of the consonant other than fricatives as illustrated in FIG. 4. FIG. 7 is a second conceptual diagram of selection of a band of the main lobe. Incidentally, as with FIG. 4, FIG. 7 illustrates the spectrum of the consonant other than fricatives. As illustrated in FIG. 7, the third threshold value and the fourth threshold value as well as the first point of inflection and the second point of inflection are defined, and the starting point and the end point of the main lobe are defined. Incidentally, an interval from the starting point to the end point may be treated as the band (width) of the lobe. For example, in the case of the consonant other than fricatives, as illustrated in FIG. 7, the selecting unit 6 may define the value of the first point of inflection at which the power of the lobe is at a minimum as the third threshold value (Th3), and define the value increased from the third threshold value by a given power (for example, 3 dB) as the fourth threshold value (Th4). Further, at the point of inflection, the selecting unit 6 may select, as the end point, the fourth point of inflection that is adjacent on only the high frequency side to the second point of inflection at which the power of the main lobe is at a maximum in a low frequency region, and is equal to or more than the third threshold value and less than the fourth threshold value. Incidentally, when there is one point of downward convex inflection as illustrated in FIG. 7, the first point of inflection and the fourth point of inflection are equivalent to each other. Incidentally, in this case, it suffices to set the second point of inflection as the starting point of the main lobe. By using the method disclosed in FIG. 7, even when a spike-like noise or frequency signal is superimposed on the main lobe, the selecting unit 6 may select the main lobe while excluding effects of the spike-like noise or frequency signal.

The control unit 7 is for example a hardware circuit based on wired logic. In addition, the control unit 7 may be a function module implemented by a computer program executed by the audio encoding device 1. The control unit 7 receives the amount of bits allocated by the allocating unit 4 from the allocating unit 4, and receives the main lobe selected by the selecting unit 6 from the selecting unit 6. When the control unit 7 receives the main lobe from the selecting unit 6 (which corresponds to Yes in step S206 in FIG. 2), the control unit 7 reduces an amount of bits allocated to a first region including the maximum value of the power of the frequency signal in the main lobe. Incidentally, such processing corresponds to step S208 in the flowchart illustrated in FIG. 2. The control unit 7 performs control of allocating an amount of unallocated bits obtained by the reduction from the first region to other than the first region, and outputs the amount of bits per unit frequency region after the control to the quantizing unit 8. Incidentally, such processing corresponds to step S209 in the flowchart illustrated in FIG. 2. In addition, when the control unit 7 does not receive the main lobe from the selecting unit 6 (which corresponds to No in step S206 in FIG. 2), it suffices for the control unit 7 to output the amount of bits allocated by the allocating unit 4 to the quantizing unit 8 as it is as the amount of bits per unit frequency region after the control. Incidentally, such processing corresponds to step S207 in the flowchart illustrated in FIG. 2.

Figure 8:
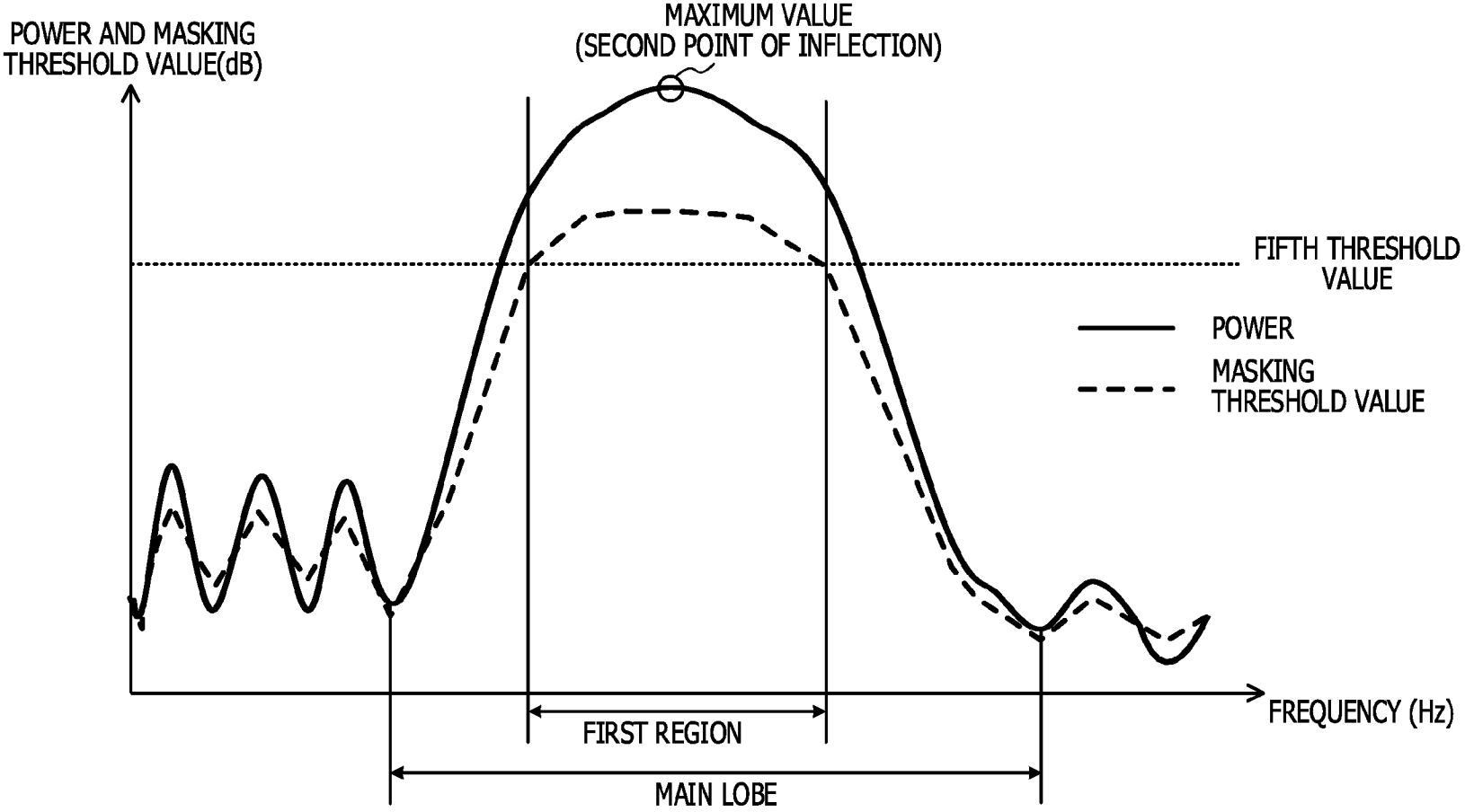
FIG. 8 is a conceptual diagram of a first region in a spectrum of a fricative consonant.
Figure 9:
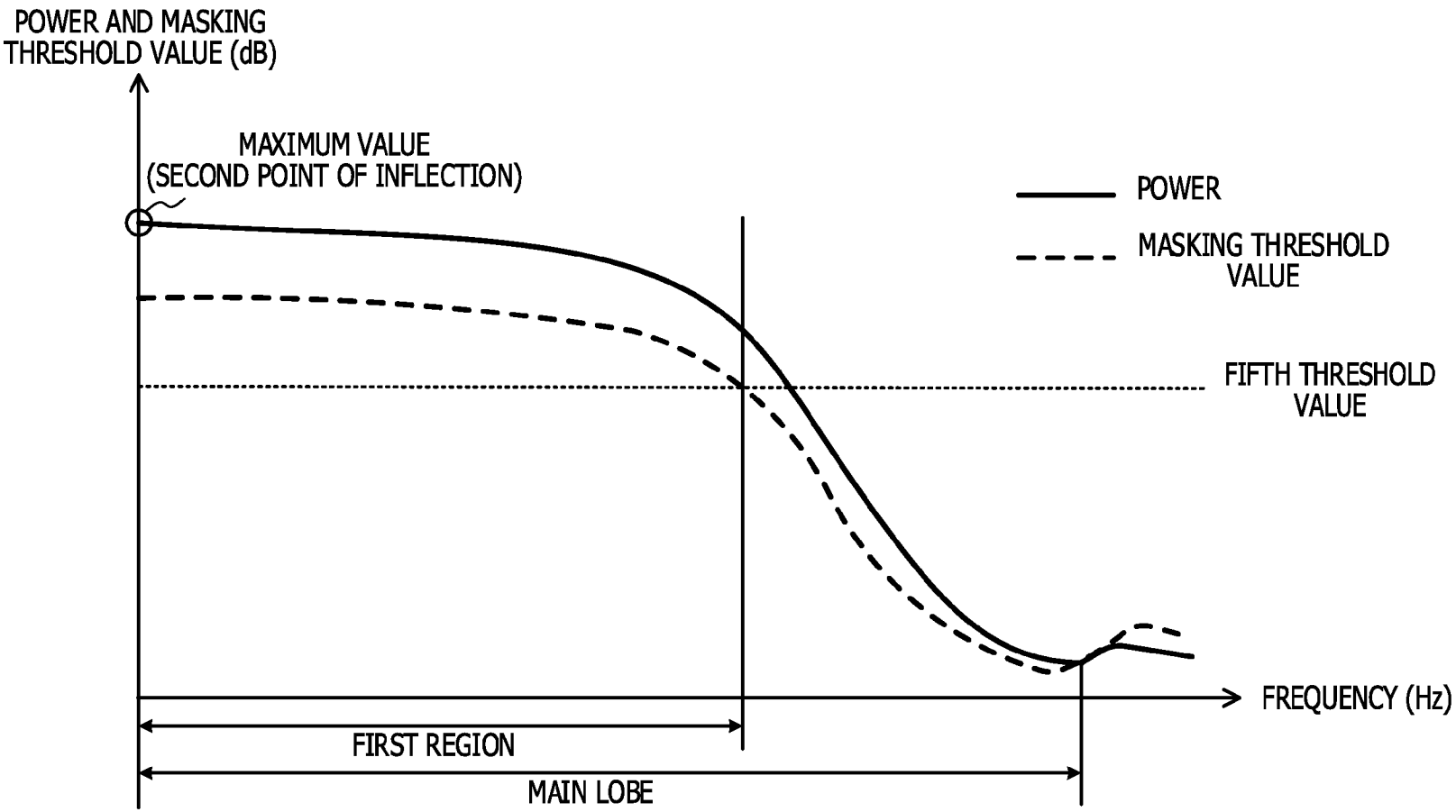
FIG. 9 is a conceptual diagram of a first region in a spectrum of a consonant other than fricatives.

Description in the following will be made of a method of defining the first region in the control unit 7. FIG. 8 is a conceptual diagram of the first region in a spectrum of a fricative consonant. FIG. 9 is a conceptual diagram of the first region in a spectrum of a consonant other than fricatives. In both of FIG. 8 and FIG. 9, the control unit 7 defines, as a fifth threshold value (Th5), a value decreased from the value of the second point of inflection at which the power of the main lobe is at a maximum value by a given power (for example, 3 dB). The control unit 7 may define, as the first region, a region in which the power of the main lobe is equal to or more than the fifth threshold value.

Incidentally, the control unit 7 may suppress a shortage of an amount of bits at the time of encoding by allocating the amount of unallocated bits obtained by the reduction from the first region to a frequency region other than the first region. As will be described later in detail, such processing does not invite a degradation in sound quality of the first region. In addition, the control unit 7 may retain the amount of unallocated bits obtained by the reduction in a present frame, and the allocating unit 4 may allocate the amount of unallocated bits obtained by the reduction in the present frame which unallocated bits are retained by the control unit 7 for the encoding of the frequency signal in a next frame. It is thus possible to suppress a shortage of an amount of bits at the time of encoding of the next frame. Incidentally, as will be described later in detail, degradation in sound quality does not occur even when the amount of bits in the first region in the present frame is reduced by a given amount. Thus, a shortage of an amount of bits for encoding processing as a whole may be suppressed without a degradation in sound quality.

Further, the control unit 7 may reduce an amount of bits on the high frequency side with the second point of inflection of the maximum value as a reference point in the first region, and allocate an amount of unallocated bits obtained by the reduction to other than the first region. In this case, the processing cost of the control unit 7 may be reduced. Incidentally, in general, the frequency signal on the low frequency side is perceived more easily. Thus, in the first example, the amount of bits on the high frequency side is reduced. However, as needed, the control unit 7 may reduce an amount of bits on the low frequency side with the second point of inflection of the maximum value as the reference point, and allocate an amount of unallocated bits obtained by the reduction to other than the first region.

Description in the following will be made of one viewpoint of technical significance of the first example. The present inventor et al. minutely verified the characteristics of audio signals in encoding at a low bit rate, and found the following as a result of diligent verification. For example, a fricative consonant as illustrated in the spectrum of FIG. 3 has a high power and a wide lobe (corresponding to the first region in the main lobe) on the high frequency side of the frequency band. In addition, a consonant other than fricatives as illustrated in the spectrum of FIG. 4 has a high power and a wide lobe (corresponding to the first region in the main lobe) on the low frequency side. Here, as a result of diligent verification, the present inventor et al. have found that in a region of continuous high-power bands (which region corresponds to the first region) in the main lobe as in the case of the consonants, sound quality is not degraded even when an ordinary amount of allocated bits based on a masking threshold value which bits are allocated by the allocating unit 4 is further reduced.

Figure 10:
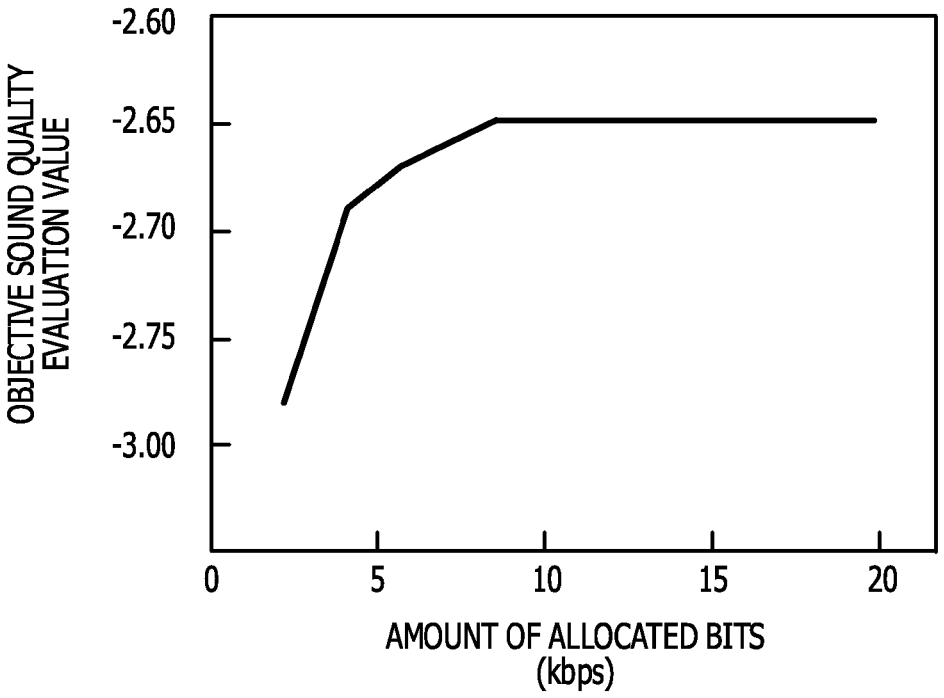
FIG. 10 is a relation diagram of an amount of allocated bits in a first region and an objective sound quality evaluation value.

FIG. 10 is a relation diagram of an amount of allocated bits in the first region and an objective sound quality evaluation value. In a corresponding verification experiment, a bit rate was set at 64 kbps, and the voice of female speech was used for a sound source. FIG. 10 illustrates the objective sound quality evaluation value in a case where the amount of allocated bits of the first region is reduced stepwise. Incidentally, an ordinary decoding method was used as a decoding method. An evaluation method used was an objective sound quality evaluation value referred to as an objective difference grade (ODG). Incidentally, the ODG is expressed between "0" to "−5," and indicates that the larger (the closer to zero) the ODG value, the better the sound quality. Incidentally, in general, when there is a difference of 0.1 or more in the ODG, a difference in sound quality may also be perceived subjectively. As illustrated in FIG. 10, it has been newly found that sound quality is not degraded in the first example even when the amount of bits of the first region is reduced to a certain degree. Incidentally, it has been confirmed that when the amount of bits is reduced more than needed, a degraded sound sounding like "shuru shuru" is superimposed on a consonant part as a result of superimposition of errors due to an omission. This degradation often occurs in the case of a band omission, and may be considered to be a degradation in sound quality which degradation is caused by the occurrence of a band omission with encoding unable to be performed due to a bit shortage in the band in which the degradation occurs.

Description has been made of the experimental facts in FIG. 10 indicating that sound quality is not degraded in the first region even when the ordinary amount of allocated bits based on a masking threshold value which bits are allocated by the allocating unit 4 is further reduced. Additional technical considerations of the experimental facts will be described. Incidentally, the considerations are related to the contents of the example, and are not used to be construed in a restrictive manner, of course. In a case of a continuous band of high spectral power, the band has signals of a plurality of frequencies uniformly or in a ratio that is close to uniformity, and therefore has characteristics of a noise-like sound. It is generally considered that the noise-like sound tends to mask sounds of other frequencies, and even when errors are increased in the noise-like sound, the errors are not easily perceived subjectively. It may therefore be considered that sound quality is not degraded even when the errors are increased by reducing the amount of allocated bits in the band. Incidentally, as illustrated in FIG. 8 and FIG. 9, the SMR in the first region maintains a substantially constant value. This is attributable to a fact that the masking threshold value represents a limit value at which the high spectral power of the input sound makes sound in neighboring bands unable to be heard. Therefore, the masking threshold value is simulated in the shape of a chevron with a frequency of the input sound as a vertex, and a largest masking threshold value among masking threshold values of a plurality of bands of the input sound is used. When there is a continuous high-power band, the masking of the band is more than the masking of adjacent bands. The SMR therefore maintains a substantially constant value.

As described above, the control unit 7 may suppress a shortage of an amount of bits at the time of encoding by allocating the amount of unallocated bits obtained by the reduction from the first region to other than the first region. In addition, as described above, the control unit 7 may retain the amount of unallocated bits obtained by the reduction in a present frame, and the allocating unit 4 allocates the amount of unallocated bits obtained by the reduction in the present frame which unallocated bits are retained by the control unit 7 for the encoding of the frequency signal in a next frame. It is thus possible to suppress a shortage of an amount of bits at the time of encoding of the next frame. Here, the amount of unallocated bits that may be obtained by the reduction in the first region is for example a fixed value, and may be defined empirically. For example, when an amount of bit reduction per unit frequency region in the first region is to be defined using the experiment result of FIG. 10, in a case where 6 kHz of a frequency interval from 5 kHz to 11 kHz is set as the first region, and the allocating unit 4 allocates an amount of bits to be allocated which amount is 15.8 kbps to the first region, no degradation in sound quality is confirmed even when the amount of bits is reduced to 8 kbps, and therefore the amount of bit reduction per unit frequency region in the first region may be defined as 1.3 kbps/kHz. In other words, the control unit 7 may define the amount of reduction in the amount of bits in the first region on the basis of the objective sound quality evaluation value. Further, because the objective sound quality evaluation value is an evaluation value simulating a subjective sound quality evaluation value, the amount of unallocated bits that may be obtained by the reduction may also be defined on the basis of the subjective sound quality evaluation value. For example, mean opinion score (MOS) evaluation, a multiple stimuli with hidden reference and anchor (MUSHRA) method, or the like may be used for the subjective sound quality evaluation value.

Description in the following will be made of technical significance of the first example from another viewpoint. The present inventor et al. further minutely verified causes that invite a degradation in sound quality of an audio signal in encoding at a low bit rate, and found the following as a result of diligent verification. For example, a fricative consonant as illustrated in the spectrum of FIG. 3 is produced by a turbulence occurring when an exhaled air passes a point narrowed within an oral cavity (for example, a point narrowed by teeth in a case of a column of characters beginning with "sa" in Japanese), and has a high power and a wide lobe (corresponding to the main lobe in the first example) on the high frequency side of the frequency band, as described above. It has been found that a band used to perceive the fricative consonant is the entire band of the main lobe including ends of the main lobe, and that when a signal in the band is lost due to an omission at a time of encoding, degradations in subjective and objective sound quality are perceived at a time of decoding. Incidentally, it has been confirmed in a subjective evaluation that a degraded sound sounding like "gyuru gyuru" is superimposed as a result of superimposition of errors due to an omission. Therefore, when the control unit 7 controls the spectrum of the fricative consonant as illustrated in the spectrum of FIG. 3, the control unit 7 may suppress a degradation in sound quality by preferentially allocating the amount of unallocated bits obtained by the reduction to the main lobe other than the first region.

The quantizing unit 8 is for example a hardware circuit based on wired logic. In addition, the quantizing unit 8 may be a function module implemented by a computer program executed by the audio encoding device 1. The quantizing unit 8 receives the frequency signal of each channel from the time-to-frequency converting unit 2, and receives the amount of allocated bits after control that corresponds to the frequency signal of each channel from the control unit 7. The quantizing unit 8 scales the frequency signal $\mathrm{spec}_{ch}(t)_i$ of each channel with a scale value based on the amount of allocated bits (after the control) of each channel, and performs quantization. Incidentally, such processing corresponds to step S210 in the flowchart illustrated in FIG. 2. The quantizing unit 8 may perform quantization by using a method described in the item of C.7 Quantization in Annex C of ISO/IEC 13818-7, for example. The quantizing unit 8 may perform quantization on the basis of the following equation, for example.

$$\mathrm{quant}_{ch}(t)_i=\mathrm{sign}(\mathrm{spec}_{ch}(t)_i)\cdot\mathrm{int}(|\mathrm{spec}_{ch}(t)_i|^{0.75}\cdot 2^{-0.1875\cdot scale_{ch}[b](t)}+0.4054) \quad \text{(Equation 5)}$$

In the above (Equation 5), $\mathrm{quant}_{ch}(t)_i$, is a quantized value of the ith frequency signal of the channel ch in the frame t, and $\mathrm{scale}_{ch}[b](t)$ is a quantization scale calculated for the frequency band in which the ith frequency signal is included. The quantizing unit 8 outputs the quantized value obtained by quantizing the frequency signal of each channel to the encoding unit 9.

The encoding unit 9 in FIG. 1 is for example a hardware circuit based on wired logic. In addition, the encoding unit 9 may be a function module implemented by a computer program executed by the audio encoding device 1. The encoding unit 9 receives the quantized value of the audio signal of each channel from the quantizing unit 8. The encoding unit 9 encodes the quantized value of the frequency signal of each channel which quantized value is received from the quantizing unit 8 by using an entropy code such as a Huffman code, an arithmetic code, or the like. Next, the encoding unit 9 calculates a total amount of bits $\mathrm{totalBit}_{ch}(t)$ of the entropy code for each channel. Next, the encoding unit 9 determines whether or not the total amount of bits $\mathrm{totalBit}_{ch}(t)$ of the entropy code is less than an amount of bits to be allocated $\mathrm{pBit}_{ch}(t)$ which amount is based on a bit rate (for example, 64 kbps) defined in advance. Incidentally, such processing corresponds to step S211 in the flowchart illustrated in FIG. 2. When the encoding unit 9 determines that the total number of bits $\mathrm{totalBit}_{ch}(t)$ of the entropy code is less than the amount of bits to be allocated $\mathrm{pBit}_{ch}(t)$ which amount is based on the bit rate defined in advance (which corresponds to Yes in step S211 in FIG. 2), the encoding unit 9 outputs the entropy code as an encoded audio signal to the multiplexing unit 10. Incidentally, such processing corresponds to step S212 in the flowchart illustrated in FIG. 2.

When the encoding unit 9 determines that the total number of bits $\mathrm{totalBit}_{ch}(t)$ of the entropy code in an arbitrary frame of an arbitrary channel is equal to or more than the amount of bits to be allocated $\mathrm{pBit}_{ch}(t)$ (which corresponds to No in step S211 in FIG. 2), it suffices for the encoding unit 9 to perform encoding while omitting the quantized values of all of frequency regions having a power less than a sixth threshold value (Th6), which is an arbitrary variable threshold value. Incidentally, such processing corresponds to step S213 in the flowchart illustrated in FIG. 2.

Further, in a case where the given bit rate is not satisfied even when the quantized values of all of the frequency bands having a power less than the arbitrary sixth threshold value are omitted in step S213, the encoding unit 9 may encode the audio signal on the basis of the SMR as needed. The encoding unit 9 may encode more auditorily important bands by performing the omission in increasing order of the SMR in encoding processing. For example, the encoding unit 9 omits bands having a power below the sixth threshold value as a variable threshold value in increasing order of the SMR, and performs encoding while increasing the sixth threshold value until the given bit rate is not exceeded. The encoding unit 9 outputs the audio signal of each channel which audio signal is obtained by the encoding (which audio signal may be referred to as an encoded audio signal) to the multiplexing unit 10.

Figure 11:
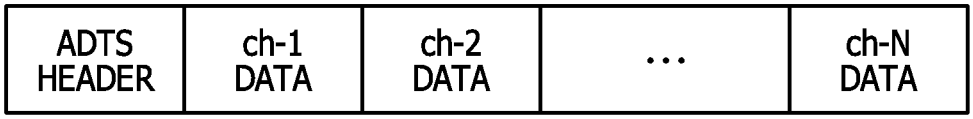
FIG. 11 is a diagram illustrating an example of a data format in which a multiplexed audio signal is stored.

The multiplexing unit 10 in FIG. 1 is for example a hardware circuit based on wired logic. In addition, the multiplexing unit 10 may be a function module implemented by a computer program executed by the audio encoding device 1. The multiplexing unit 10 receives the encoded audio signal from the encoding unit 9. The multiplexing unit 10 performs multiplexing by arranging the encoded audio signal in given order. Incidentally, such processing corresponds to step S214 in the flowchart illustrated in FIG. 2. FIG. 11 is a diagram illustrating an example of a data format in which a multiplexed audio signal is stored. In the example illustrated in FIG. 11, the encoded audio signal is multiplexed in accordance with an Mpeg-4 audio data transport stream (ADTS) format. As illustrated in FIG. 11, the data of the entropy code of each channel (ch-1 data, ch-2 data, ch-N data) is stored. In addition, header information (ADTS header) in the ADTS format is stored in front of blocks of the data of the entropy code. The multiplexing unit 10 outputs the multiplexed encoded audio signal to an arbitrary external device (for example, an audio decoding device). Incidentally, the multiplexed encoded audio signal may be output to an external device via a network.

The present inventor et al. performed a verification experiment for quantitatively indicating effects of the first example. FIG. 12 illustrates objective evaluation values of a first example and a comparative example. In the verification experiment, a bit rate was set at 64 kbps, and the voice of female speech was used for a sound source. Ordinary encoding processing was performed as the comparative example. Incidentally, in both of the first example and the comparative example, the quantized values of frequencies having a power equal to or lower than a certain threshold value were uniformly omitted so that the bit rate falls within 64 kbps. In other words, FIG. 12 illustrates a result of the verification experiment for indicating effects of the control unit 7. Incidentally, as for a decoding method, an ordinary decoding method was used under same conditions in both of the first example and the comparative example. An evaluation method used was an objective sound quality evaluation value referred to as an objective difference grade (ODG). Incidentally, as described above, the ODG is expressed between "0" to "−5," and indicates that the larger (the closer to zero) the ODG value, the better the sound quality. Incidentally, in general, when there is a difference of 0.1 or more in the ODG, a difference in sound quality may also be perceived subjectively. As illustrated in FIG. 12, an improvement of about 0.25 in the objective sound quality evaluation value over the comparative example was confirmed in the first example.

The audio encoding device illustrated in the first example may perform encoding with high sound quality even under low-bit-rate encoding conditions.

Second Example

Figure 13:
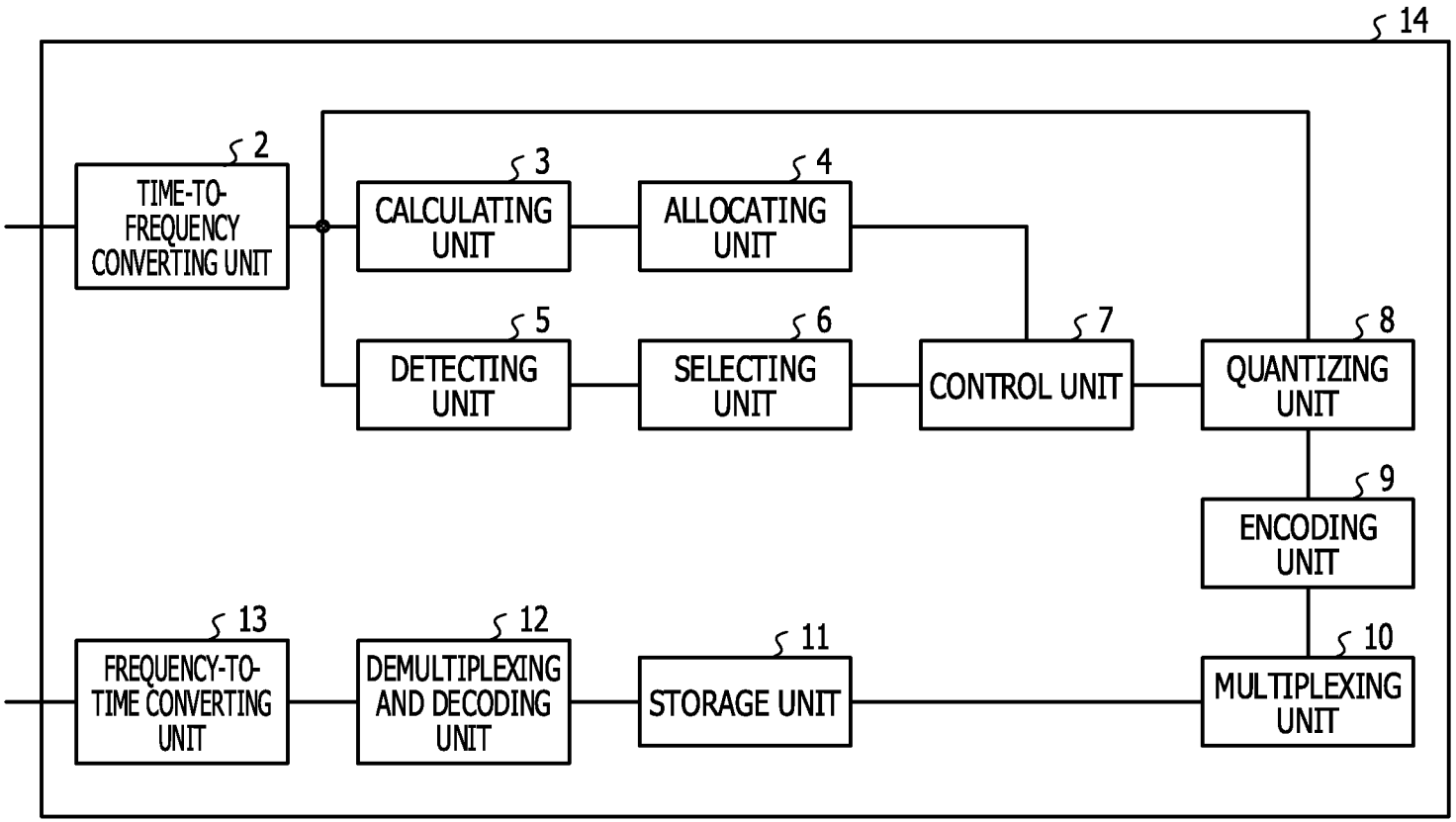
FIG. 13 is a diagram illustrating functional blocks of an audio encoding and decoding device according to one embodiment.

FIG. 13 is a diagram illustrating functional blocks of an audio encoding and decoding device according to one embodiment. As illustrated in FIG. 13, an audio encoding and decoding device 14 includes a time-to-frequency converting unit 2, a calculating unit 3, an allocating unit 4, a detecting unit 5, a selecting unit 6, a control unit 7, a quantizing unit 8, an encoding unit 9, a multiplexing unit 10, a storage unit 11, a demultiplexing and decoding unit 12, and a frequency-to-time converting unit 13.

The above-described units possessed by the audio encoding and decoding device 14 are each formed as a separate hardware circuit based on wired logic, for example. Alternatively, the above-described units possessed by the audio encoding and decoding device 14 may be implemented in the audio encoding and decoding device 14 as one integrated circuit in which circuits corresponding to the respective units are integrated. Incidentally, it suffices for the integrated circuit to be an integrated circuit such for example as an ASIC, a FPGA, or the like. Further, these units possessed by the audio encoding and decoding device 14 may be a function module implemented by a computer program executed on a processor possessed by the audio encoding and decoding device 14. The time-to-frequency converting unit 2, the calculating unit 3, the allocating unit 4, the detecting unit 5, the selecting unit 6, the control unit 7, the quantizing unit 8, the encoding unit 9, and the multiplexing unit 10 in FIG. 13 have similar functions to those disclosed in the first example, and therefore detailed description thereof will be omitted.

The storage unit 11 is for example a semiconductor memory element such as a flash memory or the like, a hard disk drive (HDD), an optical disk, or another storage device. Incidentally, the storage unit 11 is not limited to storage devices of the above-described kinds, but may be a random access memory (RAM) or a read only memory (ROM). The storage unit 11 receives a multiplexed encoded audio signal from the multiplexing unit 10. The storage unit 11 outputs the multiplexed encoded audio signal to the demultiplexing and decoding unit 12 when a user gives an instruction to reproduce the encoded audio signal to the audio encoding and decoding device 14, for example.

The demultiplexing and decoding unit 12 is for example a hardware circuit based on wired logic. In addition, the demultiplexing and decoding unit 12 may be a function module implemented by a computer program executed by the audio encoding and decoding device 14. The demultiplexing and decoding unit 12 receives the multiplexed encoded audio signal from the storage unit 11. The demultiplexing and decoding unit 12 demultiplexes the multiplexed encoded audio signal, and thereafter decodes the encoded audio signal. Incidentally, the demultiplexing and decoding unit 12 may use a method described in ISO/IEC 14496-3, for example, as a separating method. In addition, the demultiplexing and decoding unit 12 may use a method described in ISO/IEC 13818-7, for example, as a decoding method. The demultiplexing and decoding unit 12 outputs the decoded audio signal to the frequency-to-time converting unit 13.

The frequency-to-time converting unit 13 is for example a hardware circuit based on wired logic. In addition, the frequency-to-time converting unit 13 may be a function module implemented by a computer program executed by the audio encoding and decoding device 14. The frequency-to-time converting unit 13 receives the decoded audio signal from the demultiplexing and decoding unit 12. The frequency-to-time converting unit 13 converts the audio signal from a frequency signal to a time signal by using an inverse fast Fourier transform corresponding to the above (Equation 1), and thereafter outputs the audio signal to an arbitrary external device (for example, a speaker).

Thus, the audio encoding and decoding device disclosed in the second example may store an audio signal encoded with high sound quality even under low-bit-rate encoding conditions, and accurately decode the audio signal. Incidentally, such an audio encoding and decoding device may also be applied to a surveillance camera that stores an audio signal together with a video signal, for example. In addition, an audio decoding device combining the demultiplexing and decoding unit 12 and the frequency-to-time converting unit 13, for example, may be formed in the second example.

Third Example

Figure 14:
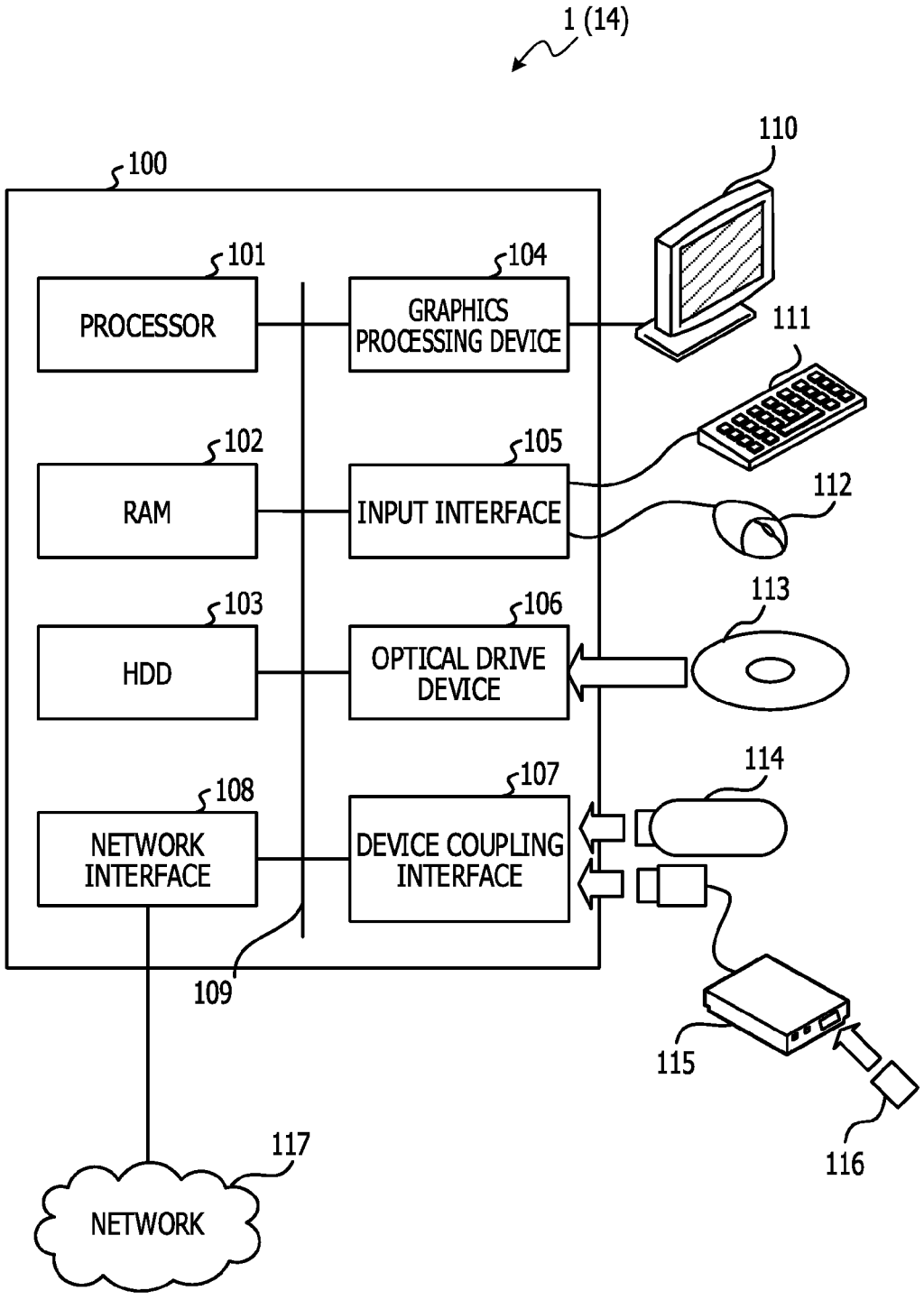
FIG. 14 is a diagram of a hardware configuration of a computer that functions as an audio encoding device or an audio encoding and decoding device according to one embodiment.

FIG. 14 is a diagram of a hardware configuration of a computer that functions as an audio encoding device or an audio encoding and decoding device according to one embodiment. The audio encoding device and audio encoding and decoding device illustrated in FIG. 14 may be the audio encoding device 1 illustrated in FIG. 1 and the audio encoding and decoding device 14 illustrated in FIG. 13, respectively. As illustrated in FIG. 14, the audio encoding device 1 or the audio encoding and decoding device 14 includes a computer 100 and input-output devices (peripheral devices) coupled to the computer 100.

A processor 101 of the computer 100 controls the whole of the device. The processor 101 is coupled with a RAM 102 and a plurality of peripheral devices via a bus 109. Incidentally, the processor 101 may be a multiprocessor. In addition, the processor 101 is for example a central processing unit (CPU), a micro processing unit (MPU), a digital signal processor (DSP), an ASIC, or a programmable logic device (PLD). Further, the processor 101 may be a combination of two or more elements of the CPU, the MPU, the DSP, the ASIC, and the PLD. Incidentally, for example, the processor 101 may perform the processing of functional blocks such as the time-to-frequency converting unit 2, the calculating unit 3, the allocating unit 4, the detecting unit 5, the selecting unit 6, the control unit 7, the quantizing unit 8, the encoding unit 9, the multiplexing unit 10, the storage unit 11, the demultiplexing and decoding unit 12, the frequency-to-time converting unit 13, and the like described in FIG. 1 or FIG. 13.

The RAM 102 is used as a main storage device of the computer 100. The RAM 102 temporarily stores at least a part of the program of an operating system (OS) and an application program that the processor 101 is made to execute. The RAM 102 also stores various kinds of data that may be necessary for processing by the processor 101. The peripheral devices coupled to the bus 109 include an HDD 103, a graphics processing device 104, an input interface 105, an optical drive device 106, a device coupling interface 107, and a network interface 108.

The HDD 103 magnetically writes and reads data on a built-in disk. The HDD 103 is for example used as an auxiliary storage device of the computer 100. The HDD 103 stores the program of the OS, the application program, and various kinds of data. Incidentally, a semiconductor storage device such as a flash memory or the like may also be used as the auxiliary storage device.

The graphics processing device 104 is coupled with a monitor 110. The graphics processing device 104 displays various kinds of images on the screen of the monitor 110 according to an instruction from the processor 101. The monitor 110 includes a display device using a cathode ray tube (CRT), a liquid crystal display device, and the like.

The input interface 105 is coupled with a keyboard 111 and a mouse 112. The input interface 105 transmits signals sent from the keyboard 111 and the mouse 112 to the processor 101. Incidentally, the mouse 112 is an example of a pointing device, and other pointing devices may also be used. The other pointing devices include a touch panel, a tablet, a touch pad, a trackball, and the like.

The optical drive device 106 reads data recorded on an optical disk 113 using laser light or the like. The optical disk 113 is a portable recording medium on which data is recorded so as to be readable by the reflection of light. The optical disk 113 includes a digital versatile disc (DVD), a DVD-RAM, a compact disc read only memory (CD-ROM), a CD-recordable/rewritable (CD-R/RW), and the like. A program stored on the optical disk 113 as a portable recording medium is installed onto the audio encoding device 1 via the optical drive device 106. The installed given program may be executed by the audio encoding device 1 or the audio encoding and decoding device 14.

The device coupling interface 107 is a communication interface for coupling peripheral devices to the computer 100. For example, the device coupling interface 107 may be coupled with a memory device 114 and a memory reader-writer 115. The memory device 114 is a recording medium having a function of communicating with the device coupling interface 107. The memory reader-writer 115 is a device that writes data to a memory card 116 or reads data from the memory card 116. The memory card 116 is a card type recording medium.

The network interface 108 is coupled to a network 117. The network interface 108 transmits and receives data to and from another computer or another communication device via the network 117.

The computer 100 realizes the above-described audio encoding processing function and the like by executing a program recorded on a computer readable recording medium, for example. The program describing the contents of processing to be executed by the computer 100 may be recorded on various recording media. The above-described program may be constituted of one or a plurality of function modules. For example, the program may be constituted of a function module that realizes the processing of the time-to-frequency converting unit 2, the calculating unit 3, the allocating unit 4, the detecting unit 5, the selecting unit 6, the control unit 7, the quantizing unit 8, the encoding unit 9, the multiplexing unit 10, the storage unit 11, the demultiplexing and decoding unit 12, the frequency-to-time converting unit 13, and the like described in FIG. 1 or FIG. 13. Incidentally, the program to be executed by the computer 100 may be stored in the HDD 103. The processor 101 loads at least a part of the program within the HDD 103 into the RAM 102, and executes the program. The program to be executed by the computer 100 may also be recorded on a portable recording medium such as the optical disk 113, the memory device 114, the memory card 116, or the like. The program stored on the portable recording medium becomes executable after being installed into the HDD 103 under control of the processor 101, for example. In addition, the processor 101 may directly read the program from the portable recording medium and execute the program.

The constituent elements of the devices illustrated above do not necessarily need to be physically configured as illustrated in the figures. That is, specific forms of distribution and integration of the devices are not limited to those illustrated in the figures, but the whole or a part of the devices may be configured so as to be distributed or integrated functionally or physically in arbitrary units according to various kinds of loads, usage conditions, and the like. In addition, the various kinds of processing described in the foregoing examples may be realized by a computer such as a personal computer, a workstation, or the like by executing a program prepared in advance.

In addition, the constituent elements of the devices illustrated in the foregoing examples do not necessarily need to be physically configured as illustrated in the figures. That is, specific forms of distribution and integration of the devices are not limited to those illustrated in the figures, but the whole or a part of the devices may be configured so as to be distributed or integrated functionally or physically in arbitrary units according to various kinds of loads, usage conditions, and the like.

In addition, the audio encoding devices in the foregoing embodiment may be implemented in various kinds of devices used for transmitting or recording an audio signal, the various kinds of devices being a computer, a video signal recorder, a video transmitting device, and the like.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio encoding device comprising:

a processor; and a memory which stores a plurality of instructions, which when executed by the processor, cause the processor to execute:

detecting a plurality of lobes based on a frequency signal constituting an audio signal;

calculating a masking threshold value of the frequency signal;

allocating an amount of bits per unit frequency region to be allocated for encoding of the frequency signal on a basis of the masking threshold value;

selecting a main lobe on a basis of bandwidth and power of the lobes; and controlling the encoding by reducing the amount of bits in a first region including a maximum value of the power in the main lobe.

2. The audio encoding device according to claim 1, wherein the selecting selects a lobe having a largest bandwidth among the plurality of the lobes as a main lobe candidate, and selects the main lobe candidate as the main lobe when the bandwidth of the main lobe candidate is equal to or more than a first threshold value and the power of the main lobe candidate is equal to or more than a second threshold value.

3. The audio encoding device according to claim 1, wherein the selecting defines, as a third threshold value, a value of a first point of inflection at which the power is at a minimum in a group of points of inflection of the plurality of the lobes, defines, as a fourth threshold value, a value increased from the third threshold value by a given power, and selects, as a starting point and an end point of the main lobe, a third point of inflection and a fourth point of inflection that are adjacent, on a low frequency side and a high frequency side, respectively, to a second point of inflection at which the power is at a maximum in the group of the points of inflection, and are equal to or more than the third threshold value and less than the fourth threshold value.

4. The audio encoding device according to claim 1, wherein the selecting defines, as a third threshold value, a value of a first point of inflection at which the power is at a minimum in a group of points of inflection of the plurality of the lobes, defines, as a fourth threshold value, a value increased from the third threshold value by a given power, defines a value at which the power is at a maximum as a second point of inflection, selects the second point of inflection as a starting point of the main lobe, and selects, as an end point of the main lobe, a fourth point of inflection that is adjacent on a high frequency side to the second point of inflection, and is equal to or more than the third threshold value and less than the fourth threshold value.

5. The audio encoding device according to claim 3, wherein the controlling defines, as the first region, a region in which the power is equal to or more than a fifth threshold value defined on a basis of the second point of inflection in the main lobe.

6. The audio encoding device according to claim 1, wherein the controlling defines an amount of reduction in the amount of bits in the first region on a basis of a subjective sound quality evaluation value or an objective sound quality evaluation value.

7. The audio encoding device according to claim 1, wherein the controlling allocates an amount of unallocated bits obtained by the reduction to other than the first region.

8. The audio encoding device according to claim 1, wherein the controlling allocates an amount of unallocated bits obtained by the reduction to the main lobe other than the first region.

9. The audio encoding device according to claim 1, wherein the controlling retains an amount of unallocated bits obtained by the reduction in a present frame, and wherein the allocating allocates the amount of unallocated bits obtained by the reduction in the present frame, the amount of unallocated bits being retained by the controlling, for encoding of the frequency signal in a next frame.

10. The audio encoding device according to claim 1, wherein the controlling reduces the amount of bits on a high frequency side with the maximum value as a reference point in the first region, and allocates an amount of unallocated bits obtained by the reduction to other than the first region.

11. An audio encoding method comprising:

detecting a plurality of lobes based on a frequency signal constituting an audio signal;

calculating a masking threshold value of the frequency signal;

allocating, by a computer processor, an amount of bits per unit frequency region to be allocated for encoding of the frequency signal on a basis of the masking threshold value;

selecting a main lobe on a basis of bandwidth and power of the lobes; and controlling the encoding by reducing the amount of bits in a first region including a maximum value of the power in the main lobe.

12. The audio encoding method according to claim 11, wherein the selecting selects a lobe having a largest bandwidth among the plurality of the lobes as a main lobe candidate, and selects the main lobe candidate as the main lobe when the bandwidth of the main lobe candidate is equal to or more than a first threshold value and the power of the main lobe candidate is equal to or more than a second threshold value.

13. The audio encoding method according to claim 11, wherein the selecting defines, as a third threshold value, a value of a first point of inflection at which the power is at a minimum in a group of points of inflection of the plurality of the lobes, defines, as a fourth threshold value, a value increased from the third threshold value by a given power, and selects, as a starting point and an end point of the main lobe, a third point of inflection and a fourth point of inflection that are adjacent, on a low frequency side and a high frequency side, respectively, to a second point of inflection at which the power is at a maximum in the group of the points of inflection, and are equal to or more than the third threshold value and less than the fourth threshold value.

14. The audio encoding method according to claim 11, wherein the selecting defines, as a third threshold value, a value of a first point of inflection at which the power is at a minimum in a group of points of inflection of the plurality of the lobes, defines, as a fourth threshold value, a value increased from the third threshold value by a given power, defines a value at which the power is at a maximum as a second point of inflection, selects the second point of inflection as a starting point of the main lobe, and selects, as an end point of the main lobe, a fourth point of inflection that is adjacent on a high frequency side to the second point of inflection, and is equal to or more than the third threshold value and less than the fourth threshold value.

15. The audio encoding method according to claim 13, wherein the controlling defines, as the first region, a region in which the power is equal to or more than a fifth threshold value defined on a basis of the second point of inflection in the main lobe.

16. The audio encoding method according to claim 11, wherein the controlling defines an amount of reduction in the amount of bits in the first region on a basis of a subjective sound quality evaluation value or an objective sound quality evaluation value.

17. The audio encoding method according to claim 11, wherein the controlling allocates an amount of unallocated bits obtained by the reduction to other than the first region.

18. The audio encoding method according to claim 11, wherein the controlling allocates an amount of unallocated bits obtained by the reduction to the main lobe other than the first region.

19. The audio encoding method according to claim 11, wherein the controlling reduces the amount of bits on a high frequency side with the maximum value as a reference point in the first region, and allocates an amount of unallocated bits obtained by the reduction to other than the first region.

20. A non-transitory computer-readable storage medium storing an audio encoding program that causes a computer to execute a process comprising:

detecting a plurality of lobes based on a frequency signal constituting an audio signal;

calculating a masking threshold value of the frequency signal;

allocating an amount of bits per unit frequency region to be allocated for encoding of the frequency signal on a basis of the masking threshold value;

selecting a main lobe on a basis of bandwidth and power of the lobes; and controlling the encoding by reducing the amount of bits in a first region including a maximum value of the power in the main lobe.

* * * * *